US008253766B2

(12) United States Patent
Koyabu et al.

(10) Patent No.: US 8,253,766 B2
(45) Date of Patent: Aug. 28, 2012

(54) THERMAL PRINTER, THERMAL PRINTER CONTROL METHOD, AND PRINTING SYSTEM

(75) Inventors: Akira Koyabu, Shiojiri (JP); Satoshi Nakajima, Azumino (JP); Yuji Takiguchi, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 862 days.

(21) Appl. No.: 12/237,507

(22) Filed: Sep. 25, 2008

(65) Prior Publication Data

US 2009/0066778 A1 Mar. 12, 2009
US 2012/0007936 A9 Jan. 12, 2012

Related U.S. Application Data

(63) Continuation of application No. 11/492,632, filed on Jul. 24, 2006, now Pat. No. 7,436,418.

(30) Foreign Application Priority Data

Jul. 25, 2005 (JP) ..... 2005-213799

(51) Int. Cl.
*B41J 2/325* (2006.01)

(52) U.S. Cl. ..... 347/215

(58) Field of Classification Search ..... None
See application file for complete search history.

(56) References Cited

U.S. PATENT DOCUMENTS

2007/0019061 A1* 1/2007 Koyabu et al. ..... 347/194
2009/0066778 A1* 3/2009 Koyabu et al. ..... 347/215

FOREIGN PATENT DOCUMENTS

JP 60165270 A * 8/1985

* cited by examiner

*Primary Examiner* — Julian Huffman
*Assistant Examiner* — Alexander C Witkowski

(57) ABSTRACT

A thermal printer 1 and control method for controlling print speed to prevent variation in printing pitch due to frequent slight changes in the print speed following a significant change in print speed. The print speed, which is the speed at which the print medium i.e., paper is conveyed when printing, is controlled based on known print speed control factors. The thermal printer comprises a paper feed mechanism for conveying the print medium at a controlled print speed passed a thermal print head, a print speed control unit 9 for controlling the print speed of the paper feed mechanism based on the print speed control factors, a print speed change acquisition unit 3 for determining the change in the print speed over a predetermined time, and a comparison unit 7 for determining if the change in print speed exceeds a predetermined threshold value. The print speed control unit 9 limits change in the print speed based on the print speed control factors for a predetermined time after the comparison unit 7 determines that the change in print speed exceeds the threshold value.

7 Claims, 8 Drawing Sheets

THERMAL PRINTER, THERMAL PRINTER CONTROL METHOD, AND PRINTING SYSTEM

CONTINUING APPLICATION DATA

This application is a continuation of, and claims priority under 35 U.S.C. §120 on, application Ser. No. 11/492,632, filed Jul. 24, 2006, now U.S. Pat. No. 7,436,418 which claims priority under 35 U.S.C. §119 on Japanese patent application no. 2005-213799, filed Jul. 25, 2005.

BACKGROUND OF THE INVENTION

1. Field of Technology

The present invention relates to a thermal printer for printing to a print medium at a controlled print medium speed relative to a print head, a thermal printer control method, and a printing system.

2. Description of Related Art

Thermal printers hold a print medium such as thermal paper between the thermal print head and a platen roller and advance the paper by rotating the platen roller. The thermal print head has heating elements (dots) arrayed in a line (one dot line) across the width of the paper, and applies current to selected dots in this dot line to produce heat and cause the thermal paper to change color. The thermal printer prints by energizing the thermal print head while advancing the thermal paper. Torque for rotating the platen roller is transferred from a rotational drive source such as a stepping motor through a transfer mechanism (a gear train) to the platen roller.

The printing speed of a thermal printer is determined by various parameters, including the energizing voltage applied to the thermal print head, the print duty (the ratio of printed dots to the number of total dots in one dot line), the temperature, printing pattern, print data communication speed, and the amount of time required for internal data processing. These parameters are hereinafter referred to as the "print speed control factors". A change in one or more of these parameters changes the print head energizing time and print speed. The print head energizing time and print speed are adjusted according to change in these print speed control factors in order to achieve the best print quality. See, for example, Japanese Unexamined Patent Appl. Pub. H06-55750. The print speed of a thermal printer is equal to the paper feed rate because printing occurs while the paper is advanced.

The change in print speed while printing with a conventional thermal printer is shown in FIG. 8.

FIG. 8 shows an example in which the print speed changes greatly in period a (decelerating in curve (A) and accelerating in curve (B)), and then frequently changes slightly in period b according to the change in the print speed control factors (including print duty). When the print speed frequently changes slightly in this way, the mechanical rigidity of the transfer mechanism and backlash in the gear train, including deformation of the rubber platen roller and the inertia of the motor, gears, and other rotating parts, affect print quality. More specifically, these factors produce an offset between the timing of the signal (such as the stepping motor excitation signal) causing the rotational drive source to turn and the timing of actual platen roller rotation (the rotational position of the platen roller). The timing of the signal (strobe signal) for energizing (heating) the thermal print head is normally determined based on the timing of the signal causing the rotational drive source to rotate.

Therefore, if the timing of actual platen roller rotation is offset from the signal causing the rotational drive source to rotate, the timing of platen roller rotation is also offset from the timing at which the thermal print head energizes and heats (the timing at which the printed dots are formed). This causes the distance between printed dots in the paper transportation direction to vary, resulting in an inconsistent printing pitch and a loss of print quality.

There is a particular tendency for a pronounced deviation in printing pitch when the print speed frequently changes slightly after a significant change in print speed because the timing of actual platen roller rotation is not stable.

This is further described below using receipt printing by a thermal printer in a POS terminal by way of example. The store name and logo, and purchase information including the name and price of each purchased product, are typically printed on a receipt. The store name and logo are generally printed first in the header at the beginning of the receipt, and the purchase information is then printed in text following the header. The print duty differs greatly during logo printing for printing graphic data and when printing text. More particularly, the print duty is high during logo printing and low when printing text. The print speed control factors, including the print duty, energizing voltage, and thermal print head temperature, therefore change greatly when changing from logo printing (period a in FIG. 8 (A)) to text printing (period b in FIG. 8 (A)), and the print speed therefore also changes greatly. During text printing the print duty tends to frequently change slightly from dot line to dot line. As a result, if purchase information or other text is printed in period b after logo printing ends, there are also frequent slight changes in the print speed control factors and the print speed frequently changes slightly. The dot pitch between the printed characters therefore varies in period b, and print quality drops.

The thermal printer, the control method, and the printing system of the present invention prevents variation in the dot pitch in the printed output of the thermal printer as a result of the print speed frequently changing slightly after a great change in the print speed.

SUMMARY OF THE INVENTION

The present invention controls the print speed of the thermal printer in response to one or more predetermined print speed control factors. The thermal printer has a paper feed mechanism; a paper transportation control unit for controlling the print speed of the paper feed mechanism based on the print speed control factors; a change acquisition unit for determining the change in the print speed over a predetermined time; and an evaluation unit for determining if the change in print speed exceeds a predetermined threshold value. If the evaluation unit determines the change in print speed exceeds the threshold value, the paper transportation control unit limits change in the print speed based on the print speed control factors for a predetermined time after the change in print speed exceeds the threshold level.

The thermal printer control method of the present invention controls the print speed of a thermal printer having a paper feed mechanism based on print speed control factors comprising the steps of: determining the change in the print speed over a predetermined time; determining if the change in print speed exceeds a predetermined threshold value; and controlling the paper feed mechanism to limit change in the print speed based on the print speed control factors for a predetermined time after the change in print speed is determined to have exceeded the threshold value.

After the print speed changes sufficiently to exceed a threshold value, change in the print speed is limited for a specified time so that printing can proceed at a stable print speed even if the print speed control factors frequently change slightly during this specified time. As a result, variations in the printing pitch in the printed output caused by frequent slight changes (not exceeding the threshold level) in the print speed after the print speed changes greatly can be prevented. A thermal printer and control method affording high quality printing can thus be provided.

The print speed control unit preferably limits the print speed to a constant speed for the predetermined time.

This aspect of the invention does not require a complicated control method to prevent a drop in print quality caused by a sudden change in the print speed.

Yet further preferably, the thermal printer also has a speed prediction unit for predicting the print speed based on the print speed control factors, and the change acquisition unit determines the change in print speed based on the predicted speed predicted by the speed prediction unit.

The thermal printer according to this aspect of the invention compares the predicted speed with a predetermined threshold value and limits change in the print speed for a predetermined time when the predicted speed exceeds the threshold value. As a result, great changes in the print speed can be predicted and frequent slight print speed changes that might follow can be prevented.

Yet further preferably, the print speed control unit limits the print speed for the predetermined time to a constant rate of acceleration to the predicted speed at the end of the predetermined time.

This aspect of the invention causes the print speed to go from the speed at which change in the print speed was limited to the speed determined by the change in the print speed control factors (the speed when limiting change in the print speed ends) at the end of this predetermined time, and these speeds are the same. The print speed therefore does not change abruptly at the end of this predetermined time, and a drop in print quality caused by a sudden change in print speed is prevented.

Further preferably, the print speed control unit in this aspect of the invention limits only reducing the print speed for the predetermined time when the change in print speed is determined to have exceeded the threshold value due to acceleration, and limits only increasing the print speed for the predetermined time when the change in print speed is determined to have exceeded the threshold value due to deceleration.

This aspect of the invention limits deceleration that will adversely affect print quality after the print speed increases, but allows acceleration that has little or no effect on print quality. Likewise, deceleration that has little or no effect on print quality is allowed after the print speed decreases, but acceleration that will adversely affect print quality is prevented. The printer can therefore respond more flexibly to changes in the print speed control factors.

The printing system of the present invention comprises a thermal printer for controlling print speed based on print speed control factors in response to commands sent to the printing system from a host computer for printing print data related to the commands. The thermal printer in the printing system comprises: a paper feed mechanism; a print speed control unit for controlling the print speed of the paper feed mechanism based on the print speed control factors; a command reception unit for receiving commands; and a printing pattern evaluation unit for determining if a received command relates to printing a specific printing pattern comprising a first printing pattern for printing at a print speed causing the change in print speed to exceed the predetermined threshold value, and a second printing pattern causing printing to proceed with frequent slight changes in the print speed after the first printing pattern. The print speed control unit limits change in the print speed based on the print speed control factors while printing the second printing pattern when the printing pattern evaluation unit determines the command relates to the specific printing pattern.

When the print data related to a received command has a specific printing pattern causing the printer to print at a print speed exceeding a predetermined threshold value, this aspect of the invention limits change in the print speed while printing the second printing pattern. As a result, frequent slight changes in the print speed that occur when printing the second printing pattern that is printed after a first printing pattern that causes the print speed to change greatly can be prevented.

Other advantages and attainments of the invention will become apparent and appreciated by referring to the following description and claims taken in conjunction with the accompanying drawings.

DESCRIPTION OF THE PREFERRED EMBODIMENTS

Figure 4:
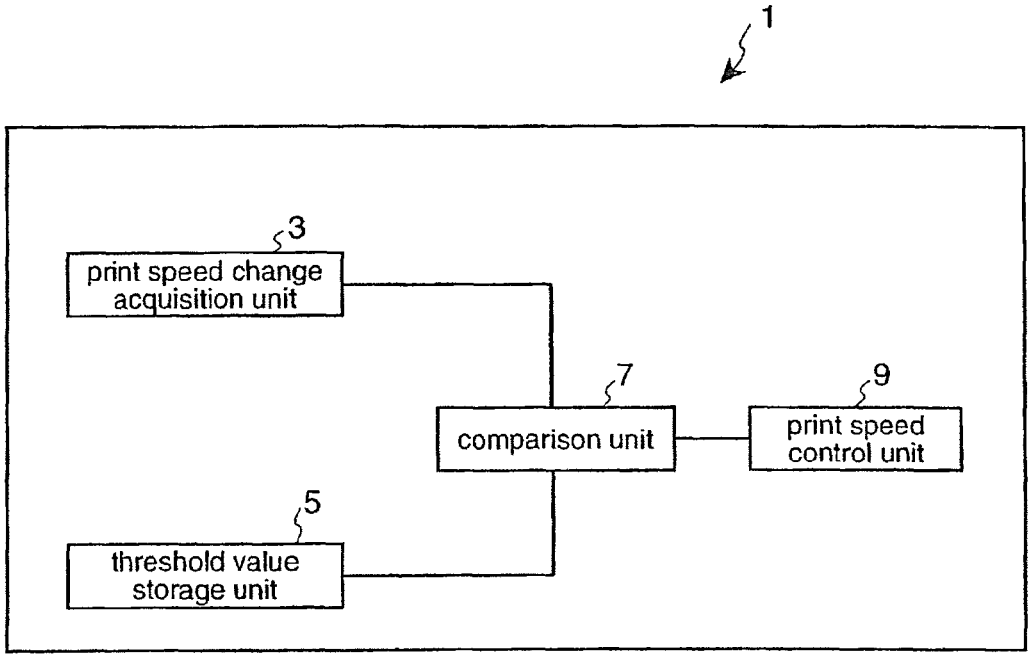
FIG. 4 is a functional block diagram of a thermal printer according to the present invention.
Figure 5:
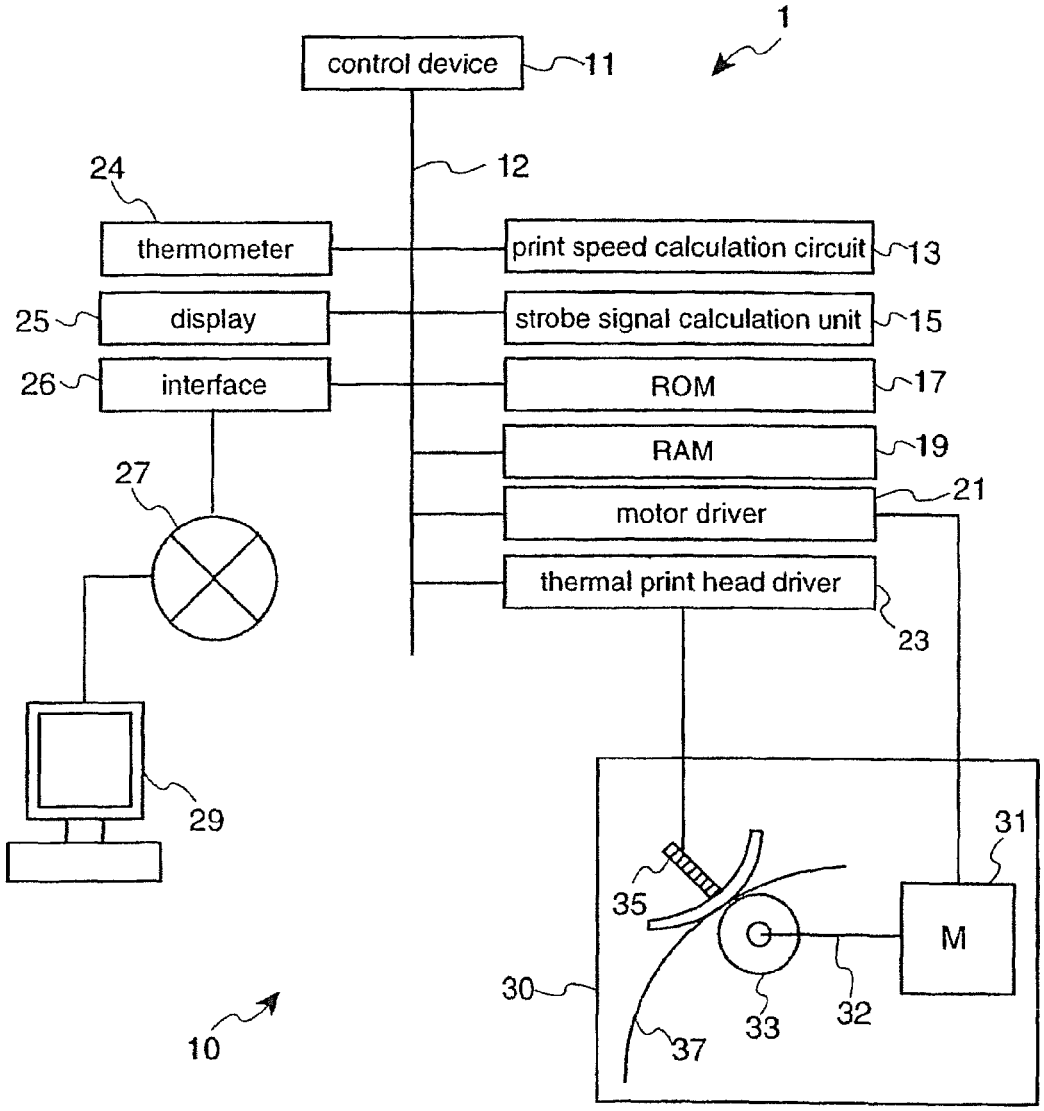
FIG. 5 is a block diagram showing the hardware configuration of a printing system having a thermal printer.
Figure 7:
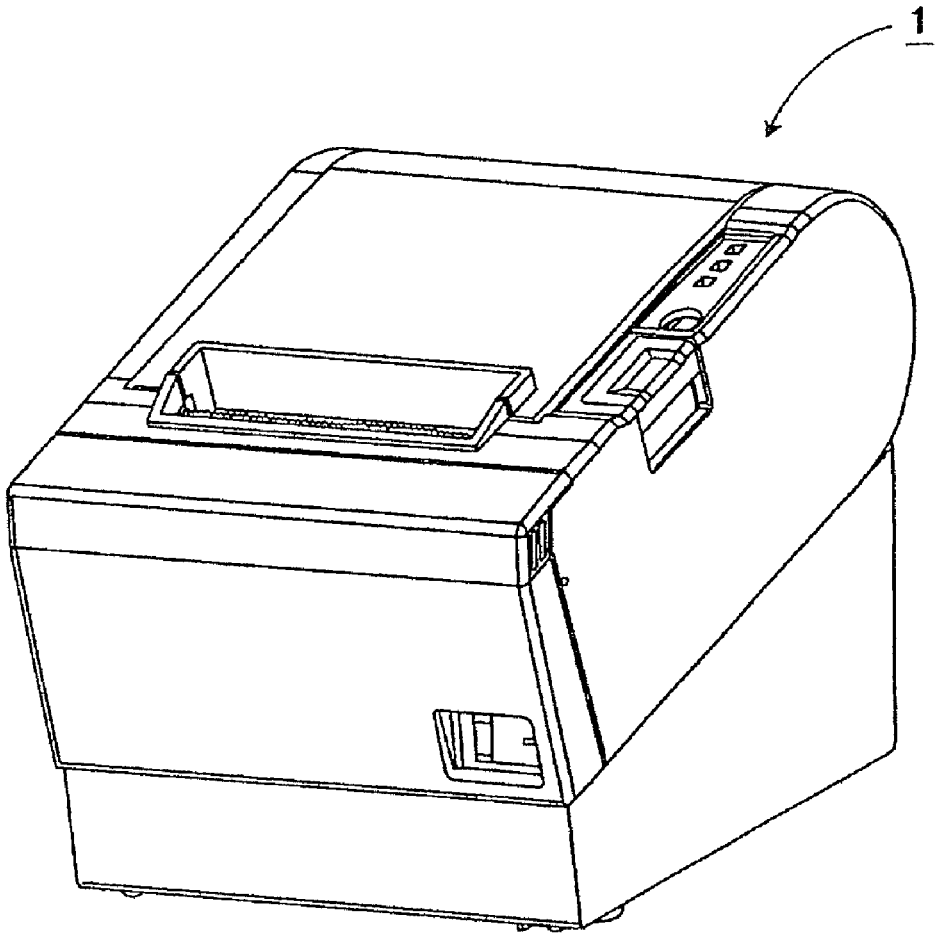
FIG. 7 is an oblique view of a thermal printer.

Referring to the drawings and in particular to FIGS. 4, 5 and 7 the thermal printer 1 of the present invention comprises: a paper feed mechanism (31, 32 and 33) as shown in FIG. 5; a print speed control unit 9(FIG. 4), comparison unit 7(FIG. 4), a threshold value storage unit 5 (FIG. 4) and a print speed acquisition unit 3 (FIG. 4). The print speed control unit 9, the comparison unit 7 and the print speed acquisition unit 3 are the functional equivalents to hardware in FIG. 5 including the control device 11 (CPU) and the print speed calculation circuit 13 which operate in conjunction with ROM 17 and RAM 19 to calculate and control the print speed of the paper feed mechanism as explained hereafter in greater detail. The print speed corresponds to the paper feed rate during printing based on the print speed control factors.

The comparison unit 7 of FIG. 4 will hereafter be referred to as an evaluation unit for determining if the change in print speed exceeds a predetermined threshold value stored in the threshold value storage unit 5 or in the host computer 29 of FIG. 5. If the evaluation unit 7 determines that the change in print speed exceeds the threshold value, the print speed control unit 9 will limit the change in the print speed based on the print speed control factors for a predetermined time following the determination that the print speed exceeds the threshold level.

The threshold value for limiting change in the print speed is desirably set according to the design and application of the thermal printer 1, and the thermal printer 1 according to this embodiment of the invention executes a stabilization mode when the print speed changes more than 30%. This 30% change in the print speed is used as the threshold value. The threshold value can be conditionally changed.

The change in the print speed is commonly based on change in the print speed control factors. Examples of these print speed control factors include such parameters as the energizing voltage applied to the thermal print head 35, the print duty (printing pattern), the temperature of the thermal print head 35 as recorded in the thermometer 24 (see FIG. 5), and the time required for internal data processing and communication of the print data by the control device (CPU) 11. The one print speed control factor that can cause a major change in the print speed is the print duty as further described below.

When the print duty is high, heat builds up easily in the thermal print head 35. The thermal printer 1 therefore lowers the print speed in order to dissipate heat and maintain the desired print quality. More specifically, the thermal printer 1 determines the print duty by means of the control device 11 (see FIG. 5) counting the number of dots printed, calculates the print speed required to achieve the desired print quality from this print duty, and controls the print speed based on the result of this calculation.

By calculating the print speed in this way, the change and the slope of the change (accelerating or decelerating) can also be predetermined as described further below.

The results of these calculations can also be stored as a data table for reference. More specifically, the thermal printer 1 reduces the print speed and shortens the thermal print head 35 energizing time when the print duty is high in order to prevent a drop in print quality due to heat accumulation in the thermal print head 35. The thermal printer 1 stores data tables containing specific combinations of the print speed control factors such as print duty, print speed, and thermal print head 35 energizing time parameters in ROM 17 (see FIG. 5), and the control device 11 selects the appropriate combination of print speed control factors or parameters to control printing. The host computer 29 (see FIG. 5) can send these data tables together with an appropriate command to the thermal printer 1 for storage. In this case nonvolatile flash ROM is used instead of ROM 17 for storage. In addition to these data tables, the host computer 29 can also send the threshold value and the length of the stabilization period (how long the stabilization mode is executed) together with an appropriate command to the thermal printer 1 for storage in memory.

Large changes in print speed can be predicted by comparing the predicted print speed acquired from a data table with a predetermined threshold value to determine if the change in print speed exceeds the threshold value. As a result, frequent slight changes in print speed that occur after a large change in print speed can be suppressed.

The change in print speed can also be measured by continuously monitoring print speed changes. This is accomplished by the print speed acquisition unit 3 and the corresponding print speed calculation circuit 13. In this situation the print speed change can be measured only when the print speed changes continuously (only when decelerating or only when accelerating), or the difference between the maximum speed and the minimum speed over a predetermined time can be used as the amount of change in the print speed.

Figure 1:
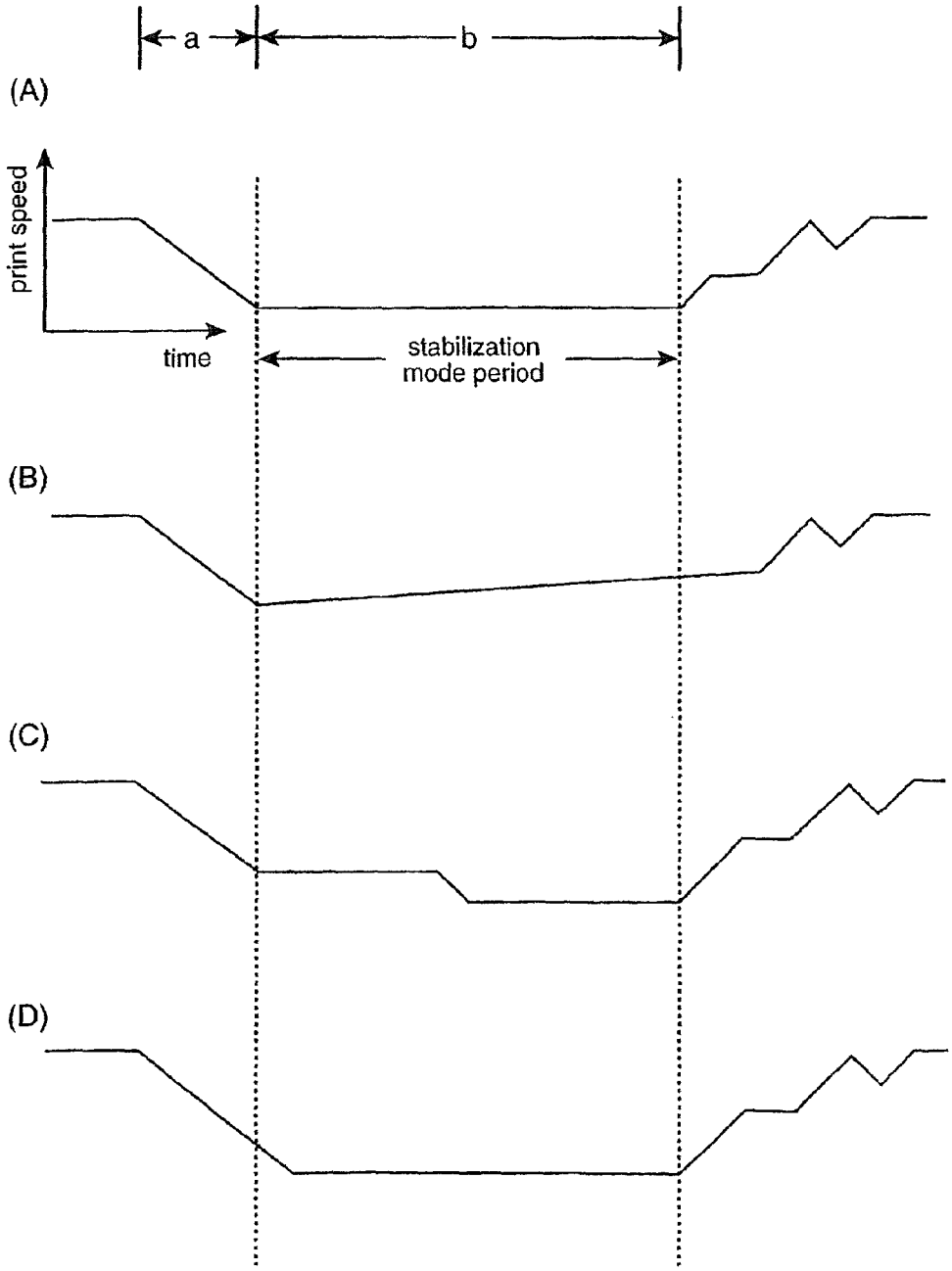
FIG. 1 is a timing chart of print speed control in a thermal printer according to a preferred embodiment of the invention.
Figure 8:
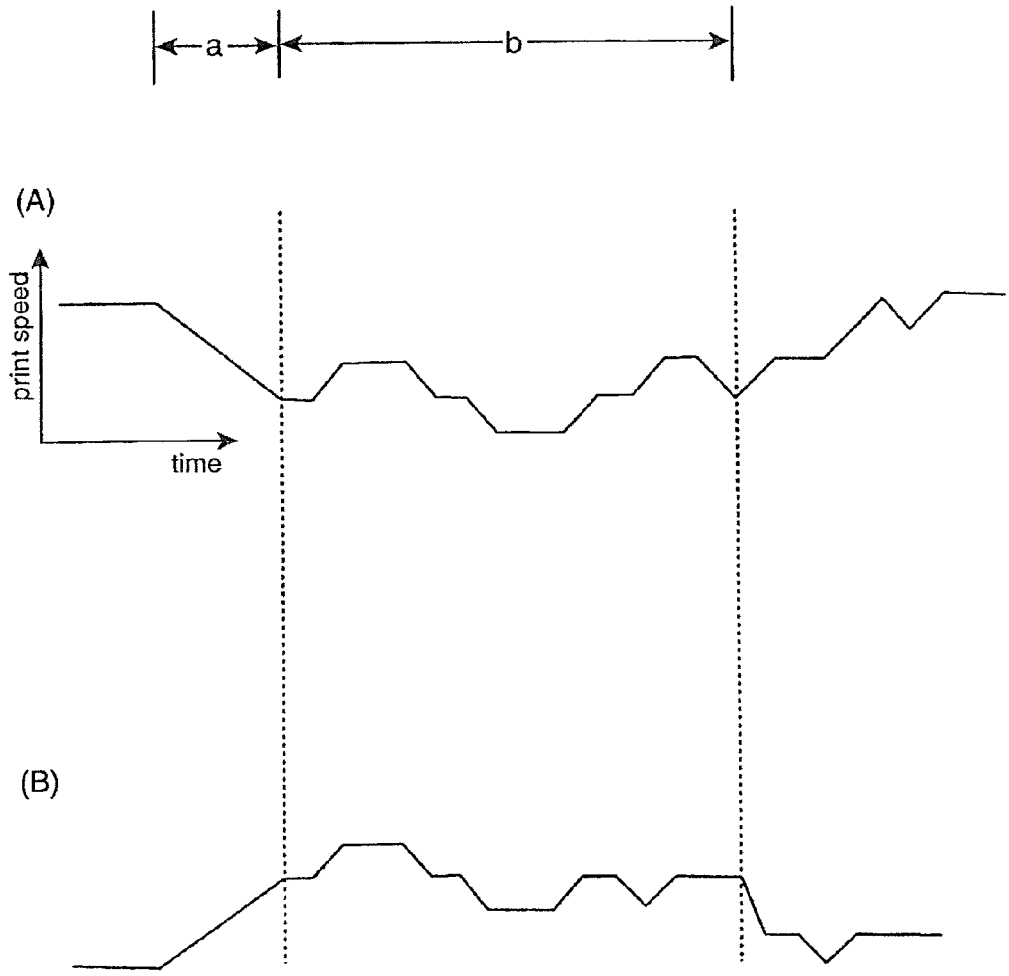
FIG. 8 is a is a timing chart showing an example of print speed control according to the prior art.

The curve in FIG. 1 (A) results from applying the method of the present invention to the example described above with reference to FIG. 8. In the example shown in FIG. 1 (A), change in the print speed is controlled (suppressed) for a predetermined time (the stabilization mode period) during period b, thus stabilizing the print speed.

The length of the stabilization period is not specifically limited but the stabilization mode preferably continues until the print duty drops (the normal (unsuppressed) print speed returns to the print speed before the stabilization mode was entered). The predetermined time the stabilization mode continues can be suitably set according to the print data. The time sufficient for slight frequent changes in the print speed to end after the print speed changes greatly can, of course, be predetermined, and the length of the stabilization mode can be set accordingly.

Because the object of the stabilization mode is to stabilize the print speed and suppress variation in the printing pitch in the printed output, slight changes in speed are allowed insofar as this objective can still be achieved. For example, if the print speed can be predicted, the print speed can increase or decrease at a constant rate to the print speed predicted at the end of the predetermined stabilization period (an example of acceleration is shown in FIG. 1 (B)). This causes the print speed to go from the speed at which limiting change in the print speed starts to a speed determined according to change in the print speed control factors (the speed when limiting the change in print speed ends) at the end of the stabilization period, and these are the same speed. The print speed therefore does not change suddenly at the end of the stabilization period, and a drop in print quality caused by a sudden change in print speed is prevented.

When the change in print speed is due to a decrease in the print speed (the change is negative) and the print speed decreases further from the low speed at the end of this change, experience has shown that there is substantially no variation in the printing pitch in the printed output because the load on the transfer mechanism 32 (see FIG. 5) is low. Therefore, when change in the print speed control factors causes the print speed to decrease further, the print speed can be reduced without limiting the change in speed in the stabilization mode (see FIG. 1 (C)). In other words, when the slope (direction) of a large change in the print speed is negative (decelerating), only an increase in the print speed is limited and a decrease in the print speed is preferably allowed. This affords flexibly responding to changes in the print speed control factors. Examples of these changes in the print speed control factors include an increase in the thermal print head temperature, an increase in the print duty, and a decrease in the energizing voltage.

If the change in print speed exceeds a predetermined threshold value in the examples shown in FIG. 1 (A) to (C), the print speed is limited to a constant speed (FIG. 1 (A)), a constant rate of acceleration (FIG. 1 (B)), or only acceleration is limited (FIG. 1 (C)) in the stabilization period referenced to the print speed when the threshold value was exceeded. As shown in FIG. 1 (D), however, the print speed can be limited to a constant speed referenced to the print speed at which deceleration ends after the change in print speed has exceeded the predetermined threshold value. The print speed can obviously also be limited to a constant rate of acceleration or only acceleration can be limited referenced to this continued decrease in the print speed.

The great change in print speed that is compared with the threshold value is described above with reference to a decrease in speed, but the same control can be applied when the great change in print speed is in the acceleration direction as described below with reference to FIG. 2.

Figure 2:
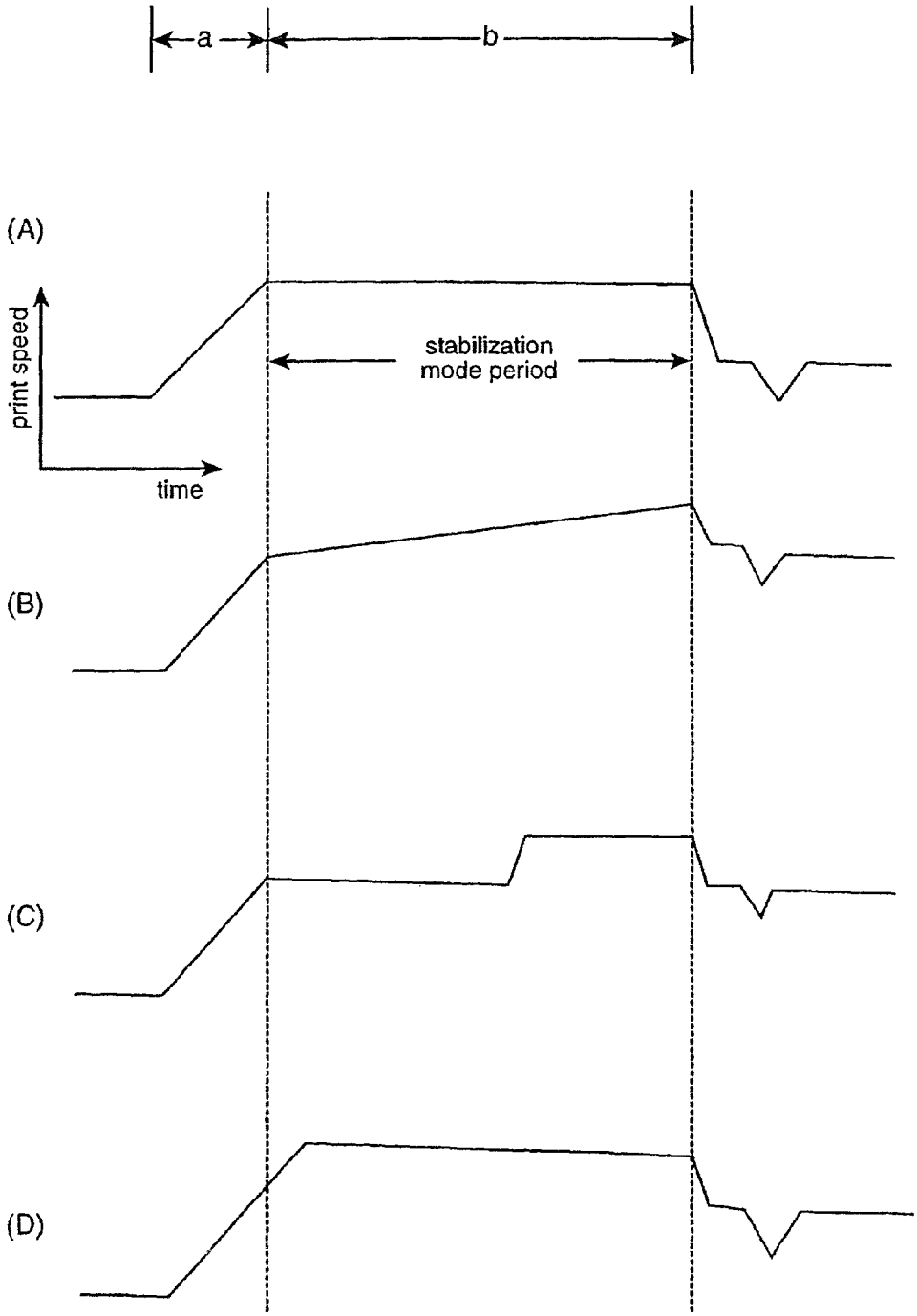
FIG. 2 is a timing chart showing another example of print speed control.

FIG. 2 (A) corresponds to FIG. 1 (A), and the print speed is held constant in the stabilization period. FIG. 2 (B) corresponds to FIG. 1 (B), and the print speed increases at a predetermined rate of acceleration to the print speed predicted for the end of the stabilization period. FIG. 2 (C) corresponds to FIG. 1 (C), and only a decrease in the print speed is suppressed in the stabilization period. Experience has also shown that there is substantially no change in the printing pitch in the printed output in this case because the load on the transfer mechanism 32 is small. FIG. 2 (D) corresponds to FIG. 1 (D), and the print speed is limited to a constant speed referenced to the print speed at which acceleration stops after the print speed change has exceeded the threshold value.

Figure 3:
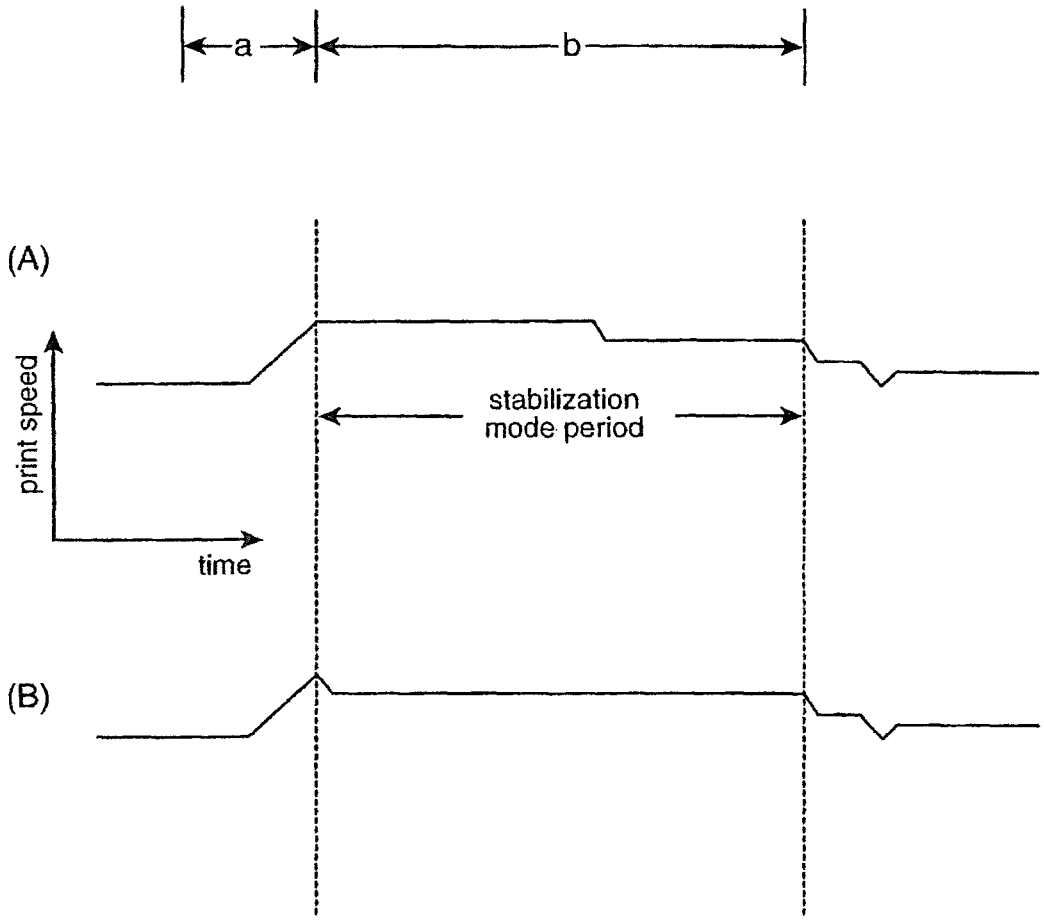
FIG. 3 is a timing chart showing yet another example of print speed control.

In the case with small changes in print speed and the threshold value is relatively low, the load on the transfer mechanism 32 will be relatively small whether the print speed increases or decreases slightly after a (small) change in print speed exceeds the threshold value. Therefore, if the change in print speed exceeds the threshold value due to acceleration when the threshold value is set relatively low, control can limit only acceleration (and allow deceleration) in the stabilization period as shown in FIG. 3 (A) instead of limiting only a decrease in print speed as shown in FIG. 2 (C). Experience has also confirmed that there is substantially no change in the printing pitch in the printed output in this situation.

Furthermore, instead of limiting the print speed to a constant speed referenced to the speed at which acceleration stops after the change in print speed exceeds the threshold value due to acceleration as shown in FIG. 2 (D), the print speed can be controlled to a constant speed referenced to a print speed decreased from the print speed when the change in print speed exceeded the threshold value due to acceleration (as shown in FIG. 3 (B)).

The thermal printer 1 according to this embodiment of the invention may be connected to a host computer 29 such that the thermal printer 1 and host computer 29 together form a printing system 10.

As shown in FIG. 4 the print speed change acquisition unit 3 interprets commands and print data sent from the host computer 29, predicts (calculates) the print speed via the print speed calculation circuit 13, and determines the change in print speed based on the predicted print speed. Once again it should be understood that the units in FIG. 4 are the functional counterparts of the hardware shown in FIG. 5 for carrying out the described functions.

The threshold value storage unit 5 stores the threshold value supplied by the host computer or from ROM for the change in print speed. The comparison or evaluation unit 7 compares the acquired change in print speed with the stored threshold value, and thereby determines if the change in print speed exceeds the predetermined threshold value. If the change in print speed exceeds the threshold value, the print speed control unit 9 executes the stabilization mode and the change in the print speed is limited.

The counterpart hardward shown in FIG. 5, includes the control device 11 which is a conventional CPU for receiving and transmitting data from other components controlled by the CPU through a common bus 12, and for processing data according to a control program read from ROM 17. For example, the control device 11 compares the change in print speed acquired by the print speed calculation circuit 13 as described below with the threshold value stored in ROM 17, and determines if the print speed change exceeds the predetermined threshold value.

The print speed calculation circuit 13, which may represent for example a GATE ARRAY or a Standard Cell, processes the print data (print duty) sent from the control device 11 and calculates the print speed. As further described below, the print speed calculation circuit 13 functioning as hardware for the print speed change acquisition unit 3 also acquires the change in print speed per unit time from the calculated print speed and integrates this change to determine the change in print speed. Alternatively, as described above, the print speed calculation circuit 13 can read the print speed from a data table previously stored in ROM 17, for example. This enables shortening the calculation time.

The motor driver 21 then controls rotation of the stepping motor 31 of the printing unit 30 according to the calculated print speed. Drive torque from the stepping motor 31 is transferred through a transfer mechanism 32 comprising a gear train to the platen roller 33. The platen roller 33 thus turns, and the thermal paper 37 held between the platen roller 33 and thermal print head 35 advances at a print speed corresponding to change in the print speed control factors. The paper feed mechanism described in the accompanying claims comprises the stepping motor 31, transfer mechanism 32, and platen roller 33.

The strobe signal calculation unit 15 processes the print speed control factors sent from the control device 11 and outputs a strobe signal controlling the energizing time of the thermal print head 35. The thermal print head driver 23 applies this strobe signal to the thermal print head 35. The thermal print head 35 energizing time is thus controlled according to this strobe signal. The heat produced by the thermal print head 35 causes the color of the thermal paper 37 to change, thereby printing.

The control program run and data tables referenced by the control device 11, and other programs and tables required to control the thermal printer 1, are stored in ROM 17. ROM 17 also stores the threshold value and the length of the stabilization period. Multiple threshold values and stabilization period lengths can also be stored so that the control device 11 can select the suitable values according to the print speed control factors.

RAM 19 temporarily stores commands and print data sent from the host computer 29, and temporarily stores the results of operations.

The thermometer 24 is a thermistor, for example, for detecting the temperature of the thermal print head 35 as one of the print speed control factors. The thermal printer 1 drive status and other information useful to the user is displayed on the display 25.

The print data and commands generated by the host computer 29 are sent over a network 27 such as the Internet or an intranet, and are captured by the thermal printer 1 through the network interface 26. The network interface 26 may function as a command reception unit of the present printing system for receiving commands from the host computer 29.

The thermal printer 1 according to this embodiment of the invention can be selectively set to execute the stabilization mode or not execute the stabilization mode. This setting can be made by setting a flag at a predetermined address in RAM 19 by means of a command, or by setting a flag at a predetermined address in a flash ROM device that is used instead of ROM 17 by means of a command. These flags are so-called memory switches. This setting can alternatively be controlled by means of a DIP switch not shown, and can be set based on a predetermined print speed or printing pattern.

Operation of this thermal printer 1 is described next.

Figure 6:
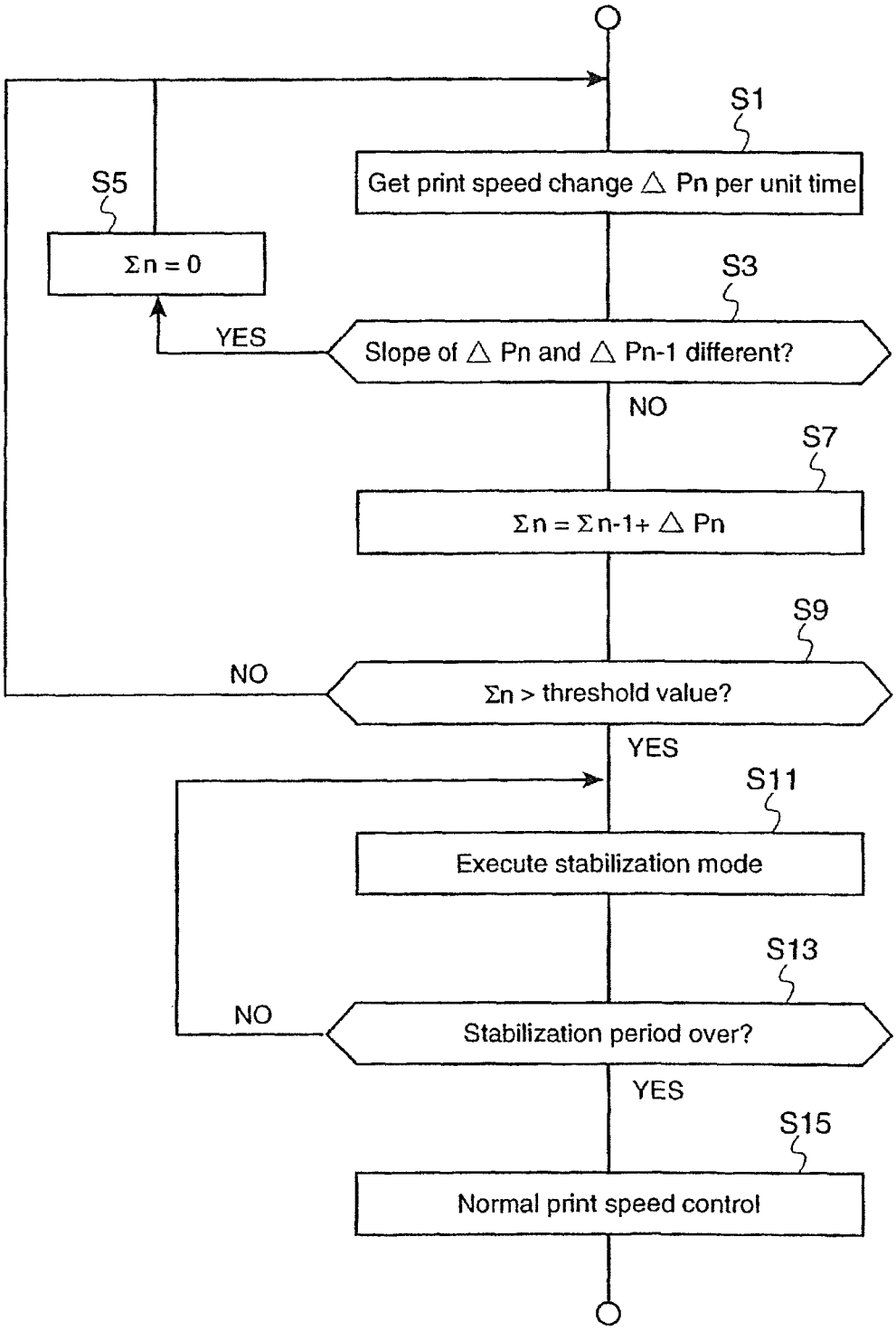
FIG. 6 is a flow chart showing the operation of the thermal printer.

The control device 11 of the thermal printer 1 in this embodiment of the invention interprets print data sent from the host computer 29 and extracts the range where a predetermined amount of change in print speed is expected to occur. When printing this data range begins, the control device 11 starts the operation shown in FIG. 6 to verify if the speed change exceeds the threshold value as described further below.

In step S1, the print speed change acquisition unit 3, the function of which may be performed by the print speed calculation circuit 13, gets the print speed change ΔPn per unit time. In order to measure only the change where the print speed changes continuously, the print speed calculation circuit 13 determines if the direction of change in print speed change ΔPn is the same or different from the direction of the previous print speed change ΔPn−1 (step S3). If they are different directions, the change in print speed is not uniform as shown in period a in the timing chart shown in FIG. 1, and the sum of the speed change Σn=P1+P2+ . . . +Pn is cleared (step S5). If the direction of the change in print speed ΔPn and ΔPn−1 are the same, or if the change in print speed goes to 0, control advances to step S7, and the print speed calculation circuit 13 accumulates the change in the print speed.

If the control device 11 determines that the sum of speed change Σn (the change in speed in a specific period of time) is greater than the threshold value (step S9), the control device 11 executes the stabilization mode and controls driving the stepping motor 31 by way of motor driver 21. The print speed is thus controlled according to the patterns shown in FIG. 1 (A) to (D), FIG. 2 (A) to (D) or FIG. 3 (A) to (B).

This embodiment of the invention executes the stabilization mode if the ratio between the print speed before the speed changed and the print speed after the speed changed ((pre-change print speed−post-change print speed)/pre-change print speed) exceeds 30%. The length of the stabilization period is approximately 330 msec. Plural values can be stored for the threshold value and stabilization period according to the printing pattern, and the appropriate threshold value and stabilization period can be selected according to the print data.

When the stabilization period ends (step S13), printing with normal print speed control, that is, printing at a print speed determined according to the change in the print speed control factors, resumes (step S15).

A printing system 10 according to this embodiment of the invention can execute the stabilization mode based on a command received by the thermal printer 1. More specifically, the control device 11 may also function as a printing pattern evaluation unit internal of the printing system 10 for determining if the command received by the interface 26 (command reception unit) relates to a specific printing pattern comprising a first printing pattern for printing at a print speed causing the change in print speed to exceed the predetermined threshold value, and a second printing pattern causing printing to proceed with frequent slight changes in the print speed after the first printing pattern is completed. If the control device 11 determines that the received print data matches this predetermined printing pattern, the change in the print speed is limited while printing the second printing pattern. As a result, frequent slight changes in the print speed can be prevented while printing the second printing pattern after printing a first printing pattern in which the print speed changes greatly.

This first printing pattern occurs when the print duty is high, such as when printing a store logo, a barcode, or other graphic or symbol, and the second printing pattern occurs when the print duty is low, such as when printing purchase information or other text. Data tables relating to the print speed and energizing time for specific print data can also be stored in the thermal printer 1 in this arrangement, and the control device 11 can set the appropriate print speed and energizing time from these data tables according to the commands received by the interface 26.

The print speed changes greatly (slows) when moving from a logo printing area with a high print duty to a text area with a low print duty when printing a sales receipt, for example, and a thermal printer 1 according to this embodiment of the invention stabilizes the print speed (executes a stabilization mode) after this change in the print speed. As a result, printing proceeds at a stable print speed during this stabilization period even if the print speed control factors frequently change slightly. More specifically, the paper feed mechanism is driven to respond to great changes in the print speed control factors, but any following small changes in the print speed control factors are ignored. As a result, when the print speed changes greatly, variation in the printing pitch in the printed output caused by any following frequent small changes in the print speed control factors can be prevented.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A thermal printer for printing to a print medium at a controlled print speed, comprising:

a print head;

a paper feed mechanism for conveying the print medium past the print head at the controlled print speed;

a print speed change acquisition unit for determining the print speed of the paper feed mechanism and a change in the print speed;

an evaluation unit responsive to information from said print speed change acquisition unit for determining if the determined change in print speed exceeds a predetermined threshold value; and a print speed control unit for controlling the print speed of the paper feed mechanism in response to information from said print speed change acquisition unit based upon speed control factors including at least one or more parameters selected from the group consisting of: a temperature of the print head, a printing pattern, an energizing voltage applied to the print head, a print data communication speed and a time required for internal data processing, wherein the print speed control unit limits the print speed to predetermined speed for at least one predetermined time when said threshold value is exceeded.

2. The thermal printer described in claim 1, further comprising a print speed calculation circuit for predicting the print speed based on the print speed control factors;

wherein the print speed change acquisition unit determines the change in print speed based on the predicted speed predicted by the print speed calculation circuit.

3. The thermal printer described in claim 2, wherein the print speed control unit limits control of print speed to reducing the print speed when the change in print speed is determined to have exceeded the threshold value due to acceleration, and limits control of print speed to increasing the print speed for the predetermined time when the change in print speed is determined to have exceeded the threshold value due to deceleration.

4. The thermal printer described in claim 1, wherein the print speed control unit limits speed control to only reducing the print speed for the predetermined time when the change in print speed is determined to have exceeded the threshold value due to acceleration, and limits speed control to only increasing the print speed for the predetermined time when the change in print speed is determined to have exceeded the threshold value due to deceleration.

5. A control method for a thermal printer adapted to include a print head and a paper feed mechanism for conveying a print medium past the print head at a controlled print speed based on certain predetermined print speed control factors, the method comprising the steps of:

determining the print speed of the print medium;

determining a change, if any, in the print speed;

determining if the change in print speed exceeds a predetermined threshold value; and controlling the paper feed mechanism to limit the change in the print speed based on said print speed control factors if the change in print speed is determined to have exceeded the threshold value;

wherein the print speed is increased for at least one predetermined time when the change in print speed is determined to have exceeded the threshold value.

6. A thermal printer for connecting to a host computer comprising:

a paper feed mechanism;

a print speed control unit for controlling the print speed of the paper feed mechanism based on given print speed control factors;

a command reception unit for receiving commands from the host computer;

a print speed change acquisition unit for establishing the print speed of the paper feed mechanism and for determining the degree of change in the print speed;

an evaluation unit for determining if the change in print speed exceeds a predetermined threshold value; and a control unit for determining if any of the received commands from the host computer relate to printing of specific printing patterns comprising:

a first printing pattern for printing at a print speed causing the change in print speed to exceed the predetermined threshold value, and a second printing pattern causing printing to proceed with frequent slight changes in the print speed after printing the first printing pattern;

wherein the print speed control unit limits change in the print speed based on the print speed control factors while printing the second printing pattern when the control unit determines that the received command relates to the first specific printing pattern.

7. A thermal printer for printing to a print medium at a controlled print speed, comprising:

a print head;

a paper feed mechanism for conveying the print medium past the print head at the controlled print speed;

a print speed change acquisition unit for determining the print speed of the paper feed mechanism and a change in the print speed; and a print speed control unit for controlling the print speed of the paper feed mechanism in response to information from said print speed change acquisition unit based upon speed control factors including at least one or more parameters selected from the group consisting of: a printing pattern, an energizing voltage applied to the print head, a print data communication speed and a time required for internal data processing.

* * * * *